US005928852A

United States Patent [19]

Ohzeki

[11] Patent Number: 5,928,852

[45] Date of Patent: Jul. 27, 1999

[54] SILVER HALIDE PHOTOGRAPHIC EMULSION

[75] Inventor: Katsuhisa Ohzeki, Kanagawa, Japan

[73] Assignee: Fuji Photo Film Co., Ltd., Kanagawa, Japan

[21] Appl. No.: 08/728,899

[22] Filed: Oct. 10, 1996

[30] Foreign Application Priority Data

Oct. 12, 1995 [JP] Japan ..... 7-289146

[51] Int. Cl.[6] ..... G03C 1/035; G03C 1/09; G03C 1/34

[52] U.S. Cl. ..... 430/567; 430/569; 430/613; 430/612; 430/605; 430/604

[58] Field of Search ..... 430/569, 567, 430/613, 612, 605, 604

[56] References Cited

U.S. PATENT DOCUMENTS

| | | | |
|---|---|---|---|
| 5,478,715 | 12/1995 | Ohzeki et al. | 430/605 |
| 5,518,871 | 5/1996 | Urabe | 430/567 |
| 5,532,119 | 7/1996 | Arcus et al. | 430/605 |
| 5,536,634 | 7/1996 | Kim | 430/613 |

FOREIGN PATENT DOCUMENTS

| | | | |
|---|---|---|---|
| 0723187 | 7/1996 | European Pat. Off. | G03C 1/07 |
| 63-220135 | 9/1988 | Japan | G03C 1/485 |

*Primary Examiner*—Mark F. Huff

*Attorney, Agent, or Firm*—Sughrue, Mion, Zinn, Macpeak & Seas, PLLC

[57] ABSTRACT

A silver halide photographic emulsion is disclosed, comprising a support having thereon at least one silver halide emulsion layer, wherein the silver halide grain contained in the silver halide emulsion layer has a silver chloride content of 50 mol % or more, 30% or more of the surface area of the grain comprises a (111) face, and the silver halide grain is formed in the presence of at least one compound represented by formula (I) and contains a hexacyano complex represented by formula (II) such that the outermost layer of the grain has a hexacyano complex concentration of at least $1\times10^{-4}$ mol/mol-Ag.

(I)

(II)

$[M(CN)_6]^{n-}$

4 Claims, 4 Drawing Sheets

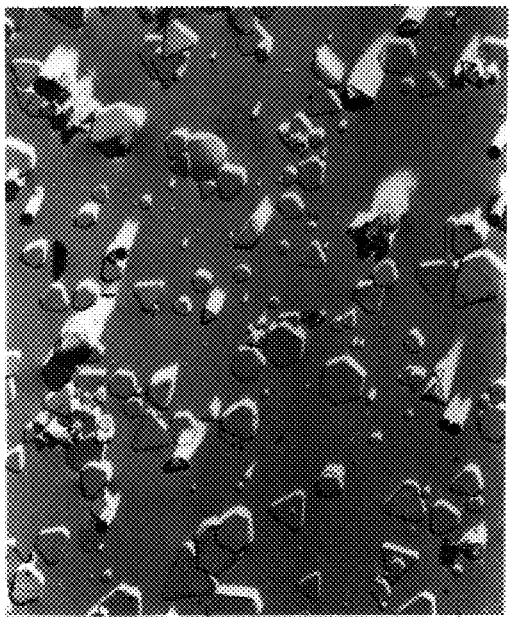
Emulsion 7-A
(Before ripening)
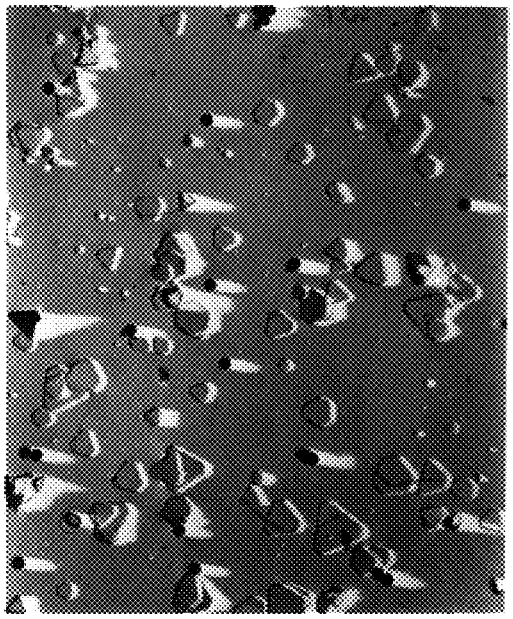
Emulsion 7-A
(After ripening)
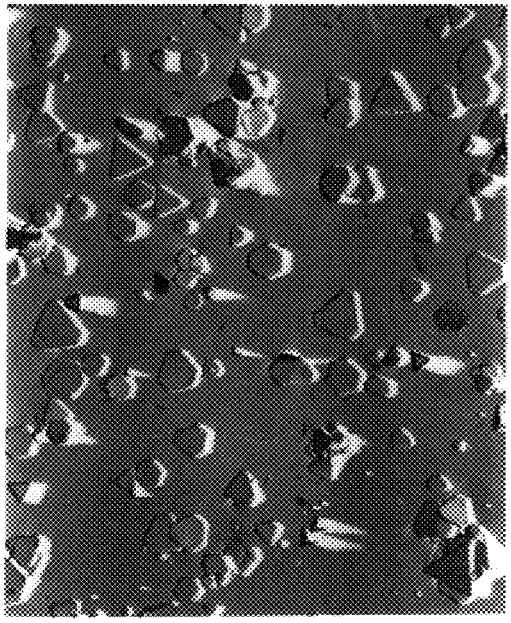
Emulsion 7-B
(Before ripening)
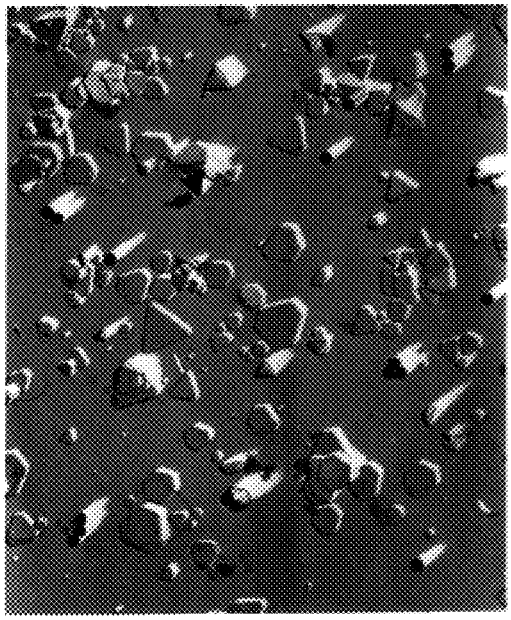
Emulsion 7-B
(After ripening)

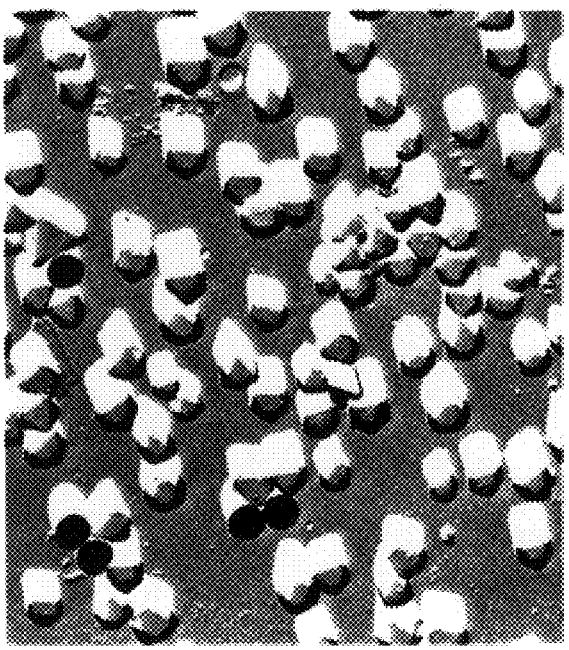
(a-1)
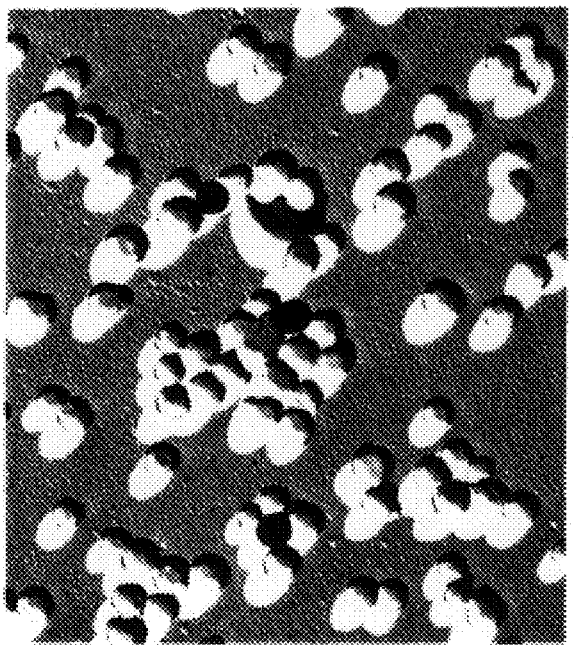
(a-2)
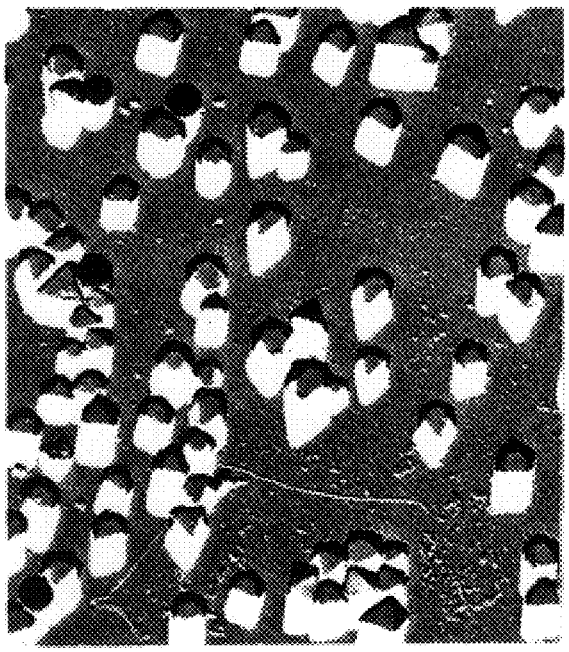
(b-1)
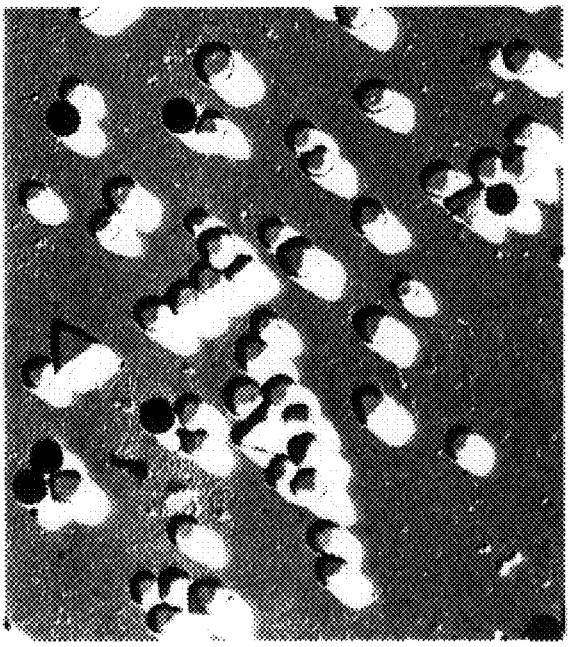
(b-2)

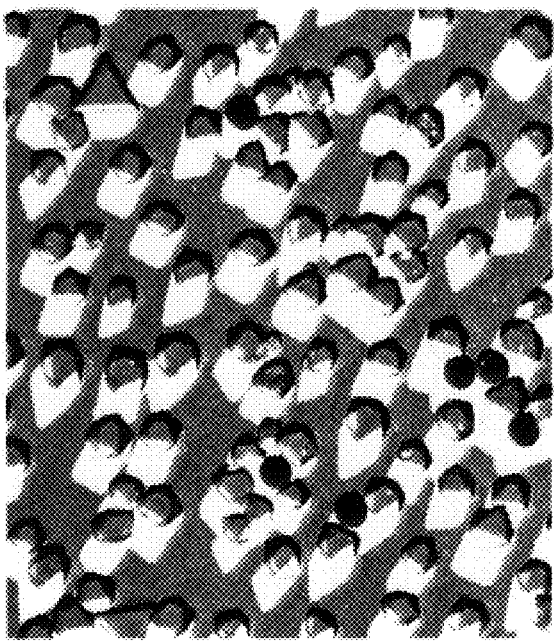
(c−1)
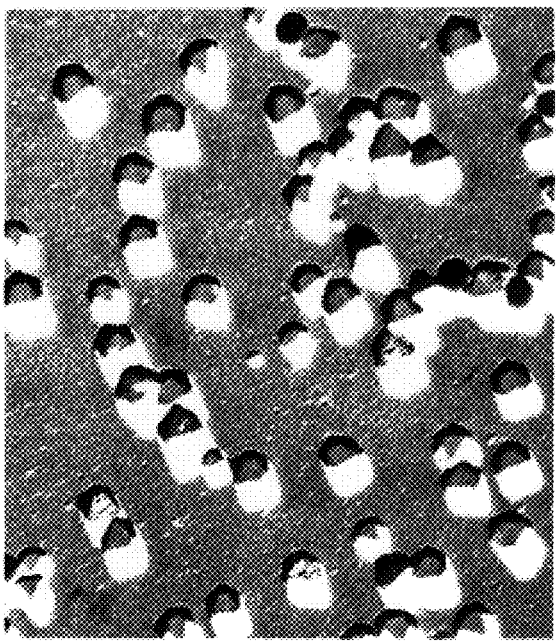
(c−2)
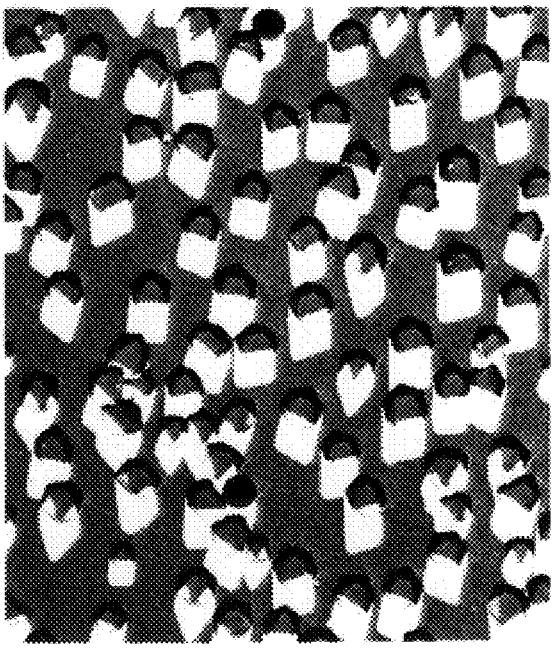
(d−1)
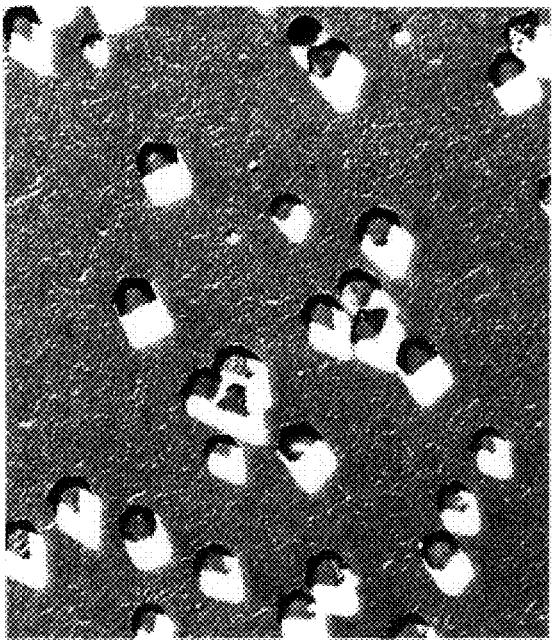
(d−2)

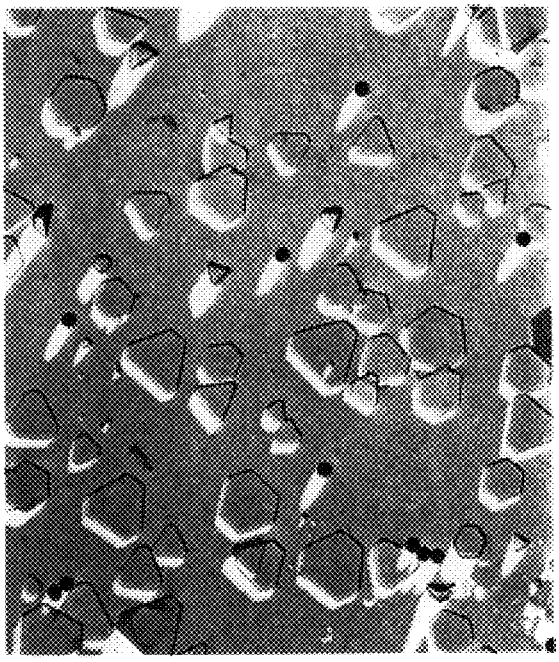
(e−1)
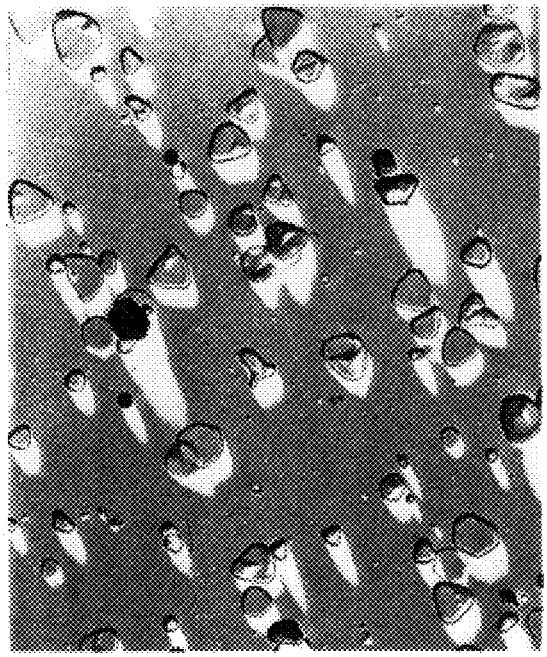
(e−2)
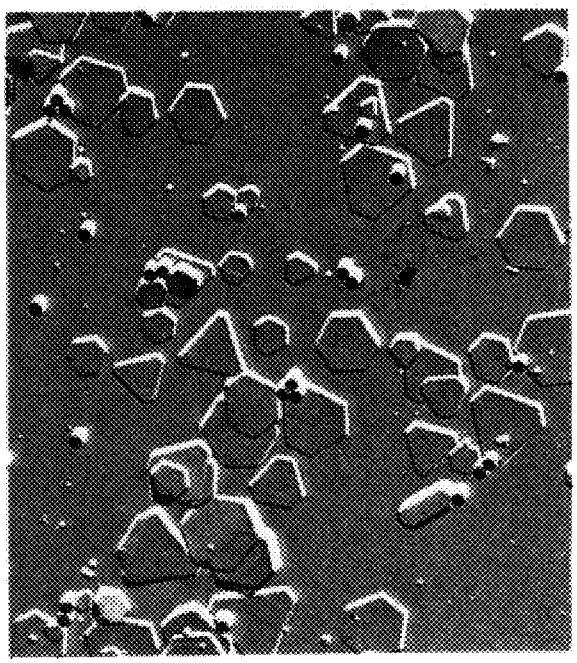
(f−1)
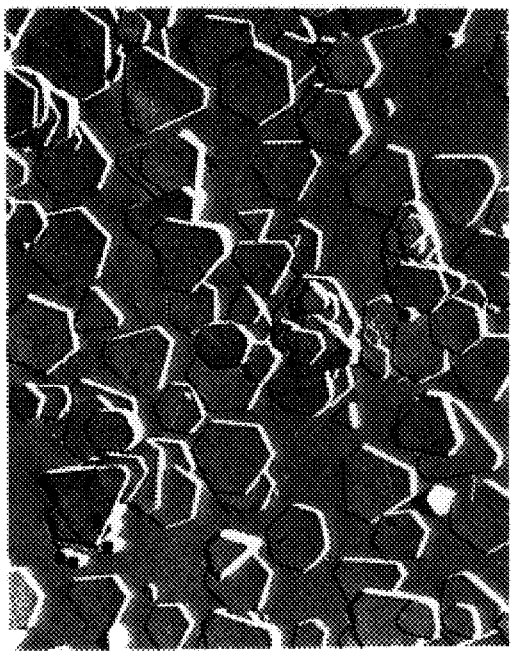
(f−2)

SILVER HALIDE PHOTOGRAPHIC EMULSION

FIELD OF THE INVENTION

The present invention relates to a silver halide photographic emulsion, more specifically, the present invention relates to stabilization of the shape of a tetradecahedral, octahedral or tabular grain having (111) faces and comprising silver chloride, or silver chlorobromide, silver chloroiodide or silver chloroiodobromide having a high silver chloride content.

BACKGROUND OF THE INVENTION

It is now needed that the development time and the fixing time can be shortened, as the performance of silver halide photographic materials, and for this purpose, silver chloride grains are noted. Silver chloride grains or grains high in silver chloride content (which mean grains having a silver chloride content of 50% or more, and which are hereinafter referred to as "high silver chloride grains") are materials well-known in the art, and are practically used in photographic materials for graphic arts printing and photographic materials for printing paper.

The high silver chloride grains are apt to be formed as grains having (100) faces on outer surfaces (hereinafter referred as to "(100) type grains") under conventional production conditions, and the grains practically used are cubic. In contrast, for silver iodobromide grains, grains mainly having (111) faces on outer surfaces (hereinafter referred to as "(111) type grains") can be easily produced, and the (111) type silver iodobromide grains are most frequently used in photographic materials for general photographing. In particular, the (111) type grains are easily formed in the tabular form, and it is possible to increase their specific area (the ratio of surface area to volume). Accordingly, they have advantages that they can be effectively subjected to spectral sensitization, and that they have high covering power after development. Also for the high silver chloride grains, therefore, it has been demanded to produce the (111) type grains.

Special means are required for the production of the (111) type high silver chloride grains. Wey discloses a method for producing high silver chloride tabular grains by use of ammonia in U.S. Pat. No. 4,399,215. The use of ammonia for the grains produced by this method further increase the solubility in the production of silver chloride grains having a high solubility, causing difficulty in producing practically useful small-sized grains. Further, the grains have the disadvantage of being liable to generate fog because they are produced at a high pH of 8 to 10. Maskasky discloses (111) type high silver chloride grains produced by use of a thiocyanate in U.S. Pat. No. 5,061,617. The thiocyanate increases the solubility of silver chloride similarly to ammonia.

Methods are known in which additives (crystal habit modifiers) are added in the grain formation in order to form the high silver chloride grains having (111) faces on outer surfaces, as shown below:

| Patent No. | Crystal Habit Modifiers | Inventor |
|---|---|---|
| U.S. Pat. No. 4,440,463 | Azaindenes + Thioether Peptizers | Maskasky |
| U.S. Pat. No. | Thiazolidine-2,4-dione | Takada |

-continued

| Patent No. | Crystal Habit Modifiers | Inventor |
|---|---|---|
| 4,783,398 | | |
| U.S. Pat. No. 4,713,323 | Aminopyrazolopyrimidine | Maskasky |
| U.S. Pat. No. 4,983,508 | Bispyridinium Salts | Ishiguro |
| U.S. Pat. No. 5,185,239 | Triaminopyrimidine | Maskasky |
| U.S. Pat. No. 5,178,997 | 7-Azaindole Compounds | Maskasky |
| U.S. Pat. No. 5,178,998 | Xanthine | Maskasky |
| JP-A-64-70741 | Dyes | Nishikawa |
| JP-A-3-212639 | Aminothioethers | Ishiguro |
| JP-A-4-283742 | Thiourea Derivatives | Ishiguro |
| JP-A-4-335632 | Triazolium Salts | Ishiguro |
| Japanese Patent Application No. 7-146891 | Monopyridinium Salts | Ohzeki |

The term "JP-A" as used herein means an "unexamined published Japanese patent application".

Among the above-described crystal habit modifiers, monopyridium salt is preferred as a photographic material because when it is used, efficiency in color sensitization is little reduced. This is disclosed in Japanese Patent Application No. 7-146891 and JP-A-2-32, and considered to be ascribable to weak adsorption of the crystal habit modifier to silver halide grains and accordingly, easiness in exchange adsorption by a sensitizing dye. This property of weak adsorption is in turn a defect that the grain is readily deformed during the production of an emulsion. Therefore, a technique for stabilizing the shape of a grain has been demanded.

In the present invention, a hexacyano complex is used. To improve the photographic performance by doping the complex to a grain has hitherto been attempted and an example thereof is disclosed in JP-B-48-35373 (the term "JP-B" as used herein means an "examined Japanese patent publication"). Also, European Patent application No. 0613044A (corresponding to Japanese Patent Application No. 5-35605) discloses a method for obtaining high sensitivity by doping an iron cyano complex to a silver chloride tabular grain produced using a bispyridinium salt. However, no conventional technique uses a hexacyano complex to a grain which is prepared using a crystal habit modifier having weak adsorption to a silver halide grain, such as a monopyridinium salt.

SUMMARY OF THE INVENTION

An object of the present invention is to stabilize the shape of a high silver chloride (111) face type grain which is produced using a monopyridinium salt as a crystal habit modifier.

The object of the present invention has been attained by:

1. a silver halide photographic emulsion comprising a support having thereon at least one silver halide emulsion layer, wherein the silver halide grain contained in the silver halide emulsion layer has a silver chloride content of 50 mol % or more, 30% or more of the surface area of the grain comprises a (111) face, and the silver halide grain is formed in the presence of at least one compound represented by formula (I) and contains a hexacyano complex represented by formula (II) such that the outermost layer of the grain has a hexacyano complex concentration of at least $1\times10^{-4}$ mol/mol-Ag:

(I)

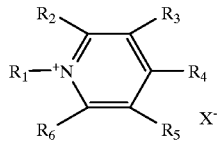

(II)

$[M(CN)_6]^{n-}$ wherein in formula (I), $R_1$ represents an alkyl group, an alkenyl group or an aralkyl group, $R_2$, $R_3$, $R_4$, $R_5$ and $R_6$ each represents a hydrogen atom or a group capable of substitution, $R_2$ and $R_3$, $R_3$ and $R_4$, $R_4$ and $R_5$ or $R_5$ and $R_6$ may be condensed to form a ring, provided that at least one of $R_2$, $R_3$, $R_4$, $R_5$ and $R_6$ is an aryl group and $R_1$, $R_2$, $R_3$, $R_4$, $R_5$ and $R_6$ each include no pyridinium group, and $X^-$ represents a counter anion; and in formula (II), M is selected from transition metals belonging to Group V-A, Group VI-A, Group VII-A and Group VIII of Periods 4, 5 and 6 in the Periodic Table, and n represents 3 or 4; and preferably Further, preferred embodiments are shown below.

2. the silver halide photographic emulsion as described in the above item 1, wherein the layer containing the hexacyano complex accounts for 50% (by volume) or less of all grains; and
3. the silver halide photographic emulsion as described in the above item 1, wherein the metal contained in the hexacyano complex is selected from the metals belonging to Group VIII.

BRIEF DESCRIPTION OF THE INVENTION

FIG. 1 is electron microphotographs each showing a crystal structure of Grain 1 (Comparison) or Grain 2 (Comparison) produced in Examples before water washing or after ripening.

Photograph (a-1) shows Grain 1 before water washing, Photograph (a-2) Grain 1 after ripening, Photograph (b-1) Grain 2 before water washing, and Photograph (b-2) Grain 2 after ripening.

Black spots in Photographs (a-1), (a-2), (b-1) and (b-2) are latex balls having a size of 0.4 to 8 $\mu$m added for the purpose of comparing the size (the same in FIG. 2 and FIG. 3).

FIG. 2 is electron microphotographs each showing a crystal structure of Grain 3 (Invention) or Grain 4 (Invention) produced in Examples before water washing or after ripening.

Photograph (c-1) shows Grain 3 before water washing, Photograph (c-2) Grain 3 after ripening, Photograph (d-1) Grain 4 before water washing, and Photograph (d-2) Grain 4 after ripening.

FIG. 3 is electron microphotographs each showing a crystal structure of Grain 6 (Comparison) or Grain 8 (Invention) produced in Examples before water washing or after ripening.

Photograph (e-1) shows Grain 6 before water washing, Photograph (e-2) Grain 6 after ripening, Photograph (f-1) Grain 8 before water washing, and Photograph (f-2) Grain 8 after ripening.

DETAILED DESCRIPTION OF THE INVENTION

The compounds of formula (I) used in the present invention is hereinafter described in detail.

In formula (I), $R_1$ is preferably a straight-chain, branched or cyclic alkyl group having 1 to 20 carbon atoms (for example, methyl, ethyl, isopropyl, t-butyl, n-octyl, n-decyl, n-hexadecyl, cyclopropyl, cyclopentyl or cyclohexyl), an alkenyl group having 2 to 20 carbon atoms (for example, allyl, 2-butenyl or 3-pentenyl) or an aralkyl group having 7 to 20 carbon atoms (for example, benzyl or phenetyl). Each group represented by $R_1$ may be substituted. The substituent groups include substitutable groups (i.e., groups capable of substitution) represented by $R_2$ to $R_6$ shown below.

$R_2$, $R_3$, $R_4$, $R_5$ and $R_6$, which may be the same or different, each represents a hydrogen atom or a substitutable group (i.e., a group capable of substitution). Examples of the substitutable groups include halogen atoms (for example, fluorine, chlorine and bromine), alkyl groups (for example, methyl, ethyl, n-propyl, isopropyl, t-butyl, n-octyl, cyclopentyl and cyclohexyl), alkenyl groups (for example, allyl, 2-butenyl and 3-pentenyl), alkynyl groups (for example, propargyl and 3-pentynyl), aralkyl groups (for example, benzyl and phenetyl), aryl groups (for example, phenyl, naphthyl and 4-methylphenyl), heterocyclic groups (for example, pyridyl, furyl, imidazolyl, piperidyl and morpholino), alkoxyl groups (for example, methoxy, ethoxy and butoxy), aryloxy groups (for example, phenoxy and 2-naphthyloxy), amino groups (for example, unsubstituted amino, dimethylamino, ethylamino and anilino), acylamino groups (for example, acetylamino and benzoylamino), ureido groups (for example, unsubstituted ureido, N-methylureido and N-phenylureido), urethane groups (for example, methoxycarbonylamino and phenoxycarbonylamino), sulfonylamino groups (for example, methylsulfonylamino and phenyisulfonylamino), sulfamoyl groups (for examples, unsubstituted sulfamoyl, N,N-dimethylsulfamoyl and N-phenylsulfamoyl), carbamoyl groups (for example, unsubstituted carbamoyl, N,N-diethylcarbamoyl and N-phenylcarbamoyl), sulfonyl groups (for example, mesyl and tosyl), sulfinyl groups (for example, methylsulfinyl and phenylsulfinyl), alkyloxycarbonyl groups (for example, methoxycarbonyl and ethoxycarbonyl), aryloxycarbonyl groups (for example, phenoxycarbonyl), acyl groups (for example, acetyl, benzoyl, formyl and pivaloyl), acyloxy groups (for example, acetoxy and benzoyloxy), phosphoric acid amide groups (for example, N,N-diethylphosphoric acid amide), alkylthio groups (for example, methylthio and ethylthio), arylthio groups (for example, phenylthio), cyano, sulfo, carboxyl, hydroxyl, phosphono, nitro, sulfino, ammonio groups (for example, trimethylammonio), phosphonio and hydrazino. These groups may be further substituted. When the groups are each substituted by two or more substituent groups, they may be the same or different. Further, $R_1$, $R_2$, $R_3$, $R_4$, $R_5$ and $R_6$ each include no pyridinium group, $R_2$ and $R_3$, $R_3$ and $R_4$, $R_4$ and $R_5$ and $R_5$ and $R_6$ may each be cyclocondensed to form a quinoline ring, an isoquinoline ring or an acridine ring.

$X^-$ represents a counter anion. Examples of the counter ions include halogen ions (chlorine and bromine ions), a nitric acid ion, a sulfuric acid ion, a p-toluenesulfonic acid ion and a trifluoromethanesulfonic acid ion.

In formula (I), $R_1$ preferably represents an aralkyl group, and at least one of $R_2$, $R_3$, $R_4$, $R_5$ and $R_6$ represents an aryl group.

In formula (I), more preferably, $R_1$ represents an aralkyl group, $R_4$ represents an aryl group, and $X^-$ represents an halogen ion.

Specific examples of the compounds used in the present invention are enumerated below. Also, the examples of other compounds which may be used in the present invention are disclosed in Japanese Patent application No. 7-146891, but the present invention is not limited thereto.

Crystal Habit Modifier (1)

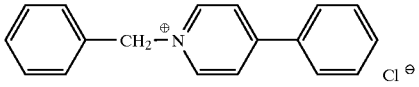

Crystal Habit Modifier (2)

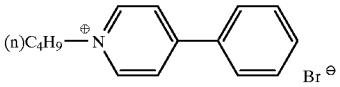

Crystal Habit Modifier (3)

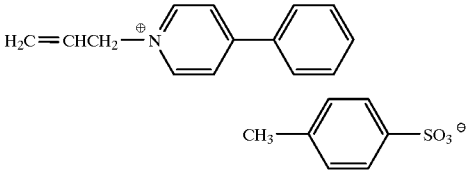

Crystal Habit Modifier (4)

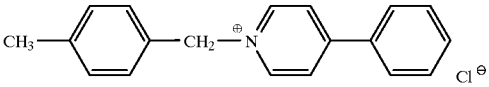

Crystal Habit Modifier (5)

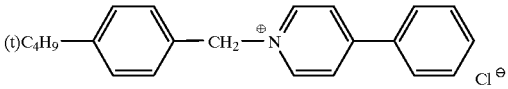

Crystal Habit Modifier (6)

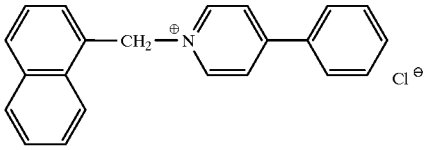

Crystal Habit Modifier (7)

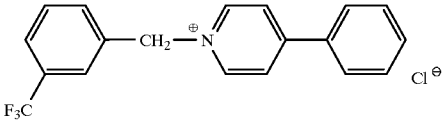

Crystal Habit Modifier (8)

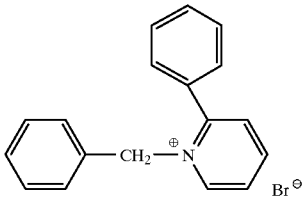

-continued

Crystal Habit Modifier (9)

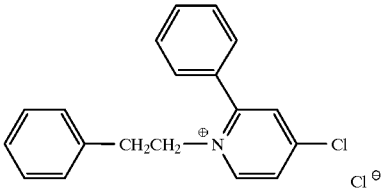

Crystal Habit Modifier (10)

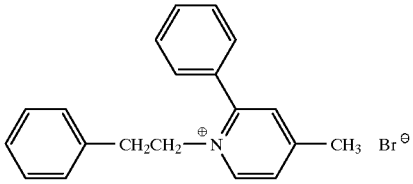

Crystal Habit Modifier (11)

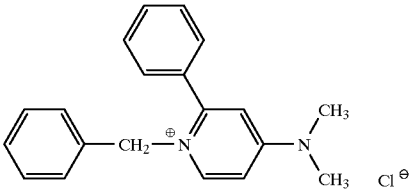

Crystal Habit Modifier (12)

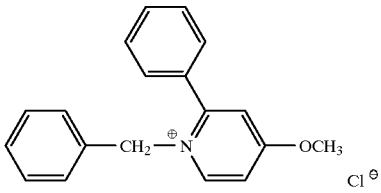

Crystal Habit Modifier (13)

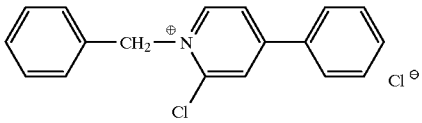

Crystal Habit Modifier (14)

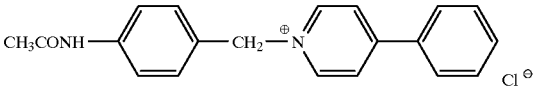

Crystal Habit Modifier (15)

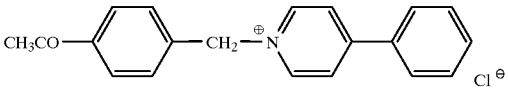

Crystal Habit Modifier (16)

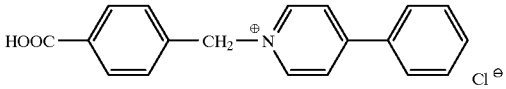

The compounds represented by formula (I) can be easily synthesized by the reaction of pyridine, quinoline, isoquinoline or acridine compounds easily available from the market with alkylating agents such as alkyl halides, and a specific synthesis example of the typical compound is shown below.

Synthesis Example 1 (Crystal Habit Modifier 1)

To 310.4 g (2 mol) of 4-phenylpyridine, 1.5 liters of isopropyl alcohol was added, and 379.6 g (3 mol) of benzyl chloride was added dropwise at room temperature. Then, the mixture was refluxed by heating for 4 hours, and isopropyl alcohol was concentrated to 750 ml under reduced pressure. After cooling to room temperature, precipitated crystals were filtered with suction to obtain 447.1 g (yield: 79.3%) of a desired product. The resulting product had a melting point of 230° C. or more. It was ascertained by the nuclear magnetic resonance spectrum, the mass spectrum, the infrared absorption spectrum and the element analysis that the resulting product was the desired product.

Crystal habit modification for forming silver halide grains having (111) faces on outer surfaces requires the compound of the present invention represented by formula (I). The amount of the compound used is preferably $6\times10^{5}$ mol or more per mol of silver halide contained in a final emulsion, and preferably is $3\times10^{-4}$ mol to $6\times10^{-2}$ mol.

The crystal habit modifier may be added at any time from nucleation of the silver halide grains to physical ripening and grain formation. After addition of the crystal habit modifier, formation of the (111) faces is initiated. The crystal habit modifier may previously be added to a reaction vessel, or may be added to a reaction vessel together with grain growth and increased in its concentration.

Using the crystal habit modifier of the present invention, regular crystalline (octahedral to tetradecahedral) and tabular grains having the (111) faces can be produced. Both can be produced properly mainly depending on the nucleation method, the time of addition of the crystal habit modifier and the amount thereof added. The nucleation methods are described below.

(1) When the regular crystalline grains are produced;

It is preferred that no crystal habit modifier is allowed to exist in nucleation. The chloride concentration in nucleation is generally 0.6 mol/liter or less, preferably 0.3 mol/liter or less, and more preferably 0.1 mol/liter or less.

(2) When the tabular grains are produced;

The tabular grain is obtained by forming two parallel twin faces. Formation of the twin faces depends on the temperature, the dispersion medium (gelatin), the halogen concentration, etc., so that these conditions are required to be suitably established. When the crystal habit modifier is allowed to exist in nucleation, the gelatin concentration is generally 0.1% to 10%, and preferably 0.15% to 5%. The chloride concentration is generally 0.01 mol/liter or more, and preferably 0.03 mol/liter or more.

When no crystal habit modifier is used in nucleation, the gelatin concentration is generally 0.03% to 10%, and preferably 0.05% to 1.0%. The chloride concentration is generally 0.001 mol/liter to 1 mol/liter, and preferably 0.003 mol/liter to 0.1 mol/liter. Although any temperature ranging from 2° C. to 90° C. can be selected as the nucleation temperature, a temperature ranging from 5° C. to 80° C. is preferred, and a temperature ranging from 5° C. to 40° C. is particularly preferred.

Then, the nuclei thus-formed are grown in the presence of the crystal habit modifier by physical ripening and addition of a silver salt and a chloride. In this case, the chloride concentration is generally 5 mol/liter or less, and preferably 0.08 mol/liter to 2 mol/liter. Although the temperature in grain growth can be selected within the range from 10° C. to 90° C., a temperature ranging from 30° C. to 80° C. is preferred. When the amount of the dispersion medium used in nucleation is insufficient for growth, it is necessary to supply the dispersion medium by addition. For growth, the amount of the gelatin used is preferably from 10 g/liter to 60 g/liter.

Although the pH in grain growth is arbitrary, the neutral to acidic regions are preferred.

In order to achieve stabilization of the shape, the hexacyano complex must be doped to a high silver chloride (111) type grain such that the outer surface layer of the grain has a hexacyano complex concentration of $1\times10^{-4}$ mol/mol-Ag or more, preferably from $2\times10^{-4}$ to $1.0\times10^{-1}$ mol-Ag, more preferably from $2\times10^{-4}$ to $1\times10^{-2}$ mol/mol-Ag. The occupation ratio of the outermost layer in the volume of grains is 3% or more, preferably 6% or more, more preferably 10% or more, but it is preferably less than 50%. The center metal is preferably iron, ruthenium, rhodium, iridium, cobalt, osmium or rhenium. Most of hexacyano complex salts are soluble in a solvent (usually an aqueous gelatin solution) for use in the formation of a silver halide emulsion and the counter cation may be any if this solubility can be maintained as long as it does not adversely affect the photographic properties. The counter cation is preferably an alkali metal or an ammonium ion.

Upon incorporating (doping) the hexacyano complex of the present invention into a silver halide grain, the pAg is preferably 8.5 or less, more preferably 7.5 or less, so as to increase the doping amount.

The hexacyano complex undergoes a ligand exchange reaction at a low pH to generate cyan and decompose. Accordingly, the pH at the time of preparation of an emulsion is preferably 3.0 or more. Even under conditions that the pH is 3.0 or more, the hexacyano complex gradually reacts with gelatin to generate cyan. The cyan generated inhibits gold sensitization and therefore, a zinc salt, a calcium salt or a magnesium salt is preferably added to prevent the cyan generation reaction. Prevention of cyan from generation is described in detail in Japanese Patent Application No. 5-35605.

Examples of the hexacyano complex salt are described below, however, the present invention is by no means limited thereto.

Dopant 1. $K_4[Fe(CN)_6]\cdot3H_2O$
Dopant 2. $K_4[Ru(CN)_6]$
Dopant 3. $K_3[Co(CN)_6]$
Dopant 4. $K_4[Re(CN)_6]$
Dopant 5. $K_3[Fe(CN)_6]$
Dopant 6. $K_4[Os(CN)_6]$
Dopant 7. $K_3[Fe(CN)_6]$
Dopant 8. $K_3[Ir(CN)_6]$ In order to improve photographic properties, a cadmium salt, a lead salt, a thallium salt, an iridium salt, a rhodium salt or a complex salt thereof may be coexisted at the time of grain formation or physical or chemical ripening of silver halide grains.

The term "high silver chloride grain" as used in the present invention means a silver chloride grain having a silver chloride content of at least 50 mol %, preferably 80 mol % or more, more preferably 95% or more. The portion other than silver chloride comprises silver bromide and/or silver iodide. A silver iodobromide layer may be localized on the grain surface and this is preferred in view of adsorption of a sensitizing dye. Also, a so-called core/shell type grain may be used.

The content of silver iodide is 20 mol % or less, preferably 10 mol % or less, more preferably 3 mol % or less.

The silver halide grain of the present invention has a surface comprising a (111) face and at least 30% or more, preferably 40% or more, more preferably 60% or more of the total surface area comprises a (111) face. The (111) face can be quantitated from an electron microphotograph of a silver halide grain formed.

When the silver halide grain of the present invention is a regular crystal, the average grain size is not particularly limited, however, it is usually from 0.1 to 5 μm, preferably from 0.2 to 3 μm.

When the silver halide grain of the present invention is a tabular grain, the diameter/thickness ratio is 2 or more, preferably from 2 to 20, more preferably from 3 to 10.

The term "diameter" of a silver halide grain as used herein means a diameter of a circle having an area equal to the projected area of a grain in an electron microphotograph.

In the present invention, the tabular silver halide grain has a diameter of from 0.3 to 5.0 μm, preferably from 0.5 to 3.0 μm, and a thickness of 0.4 μm or less, preferably 0.3 μm or less, more preferably 0.2 μm or less. The volume weighted average volume of the grain is preferably 2 $\mu m^3$ or less, more preferably 1 $\mu m^3$ or less.

In general, the tabular silver halide grain is a tabular grain having two parallel planes and therefore, the term "thickness" as used in the present invention means a distance between two parallel planes constituting the tabular silver halide grain.

The grain size distribution of the silver halide grain of the present invention may be either polydisperse or monodisperse, however, monodisperse grains are preferred.

The silver halide emulsion of the present invention may be either an internal latent type emulsion or a surface latent type emulsion.

At the time of producing silver halide grains of the present invention, a silver halide solvent may be used. Examples of silver halide solvents which are commonly used, include thiocyanates (described, for example, in U.S. Pat. Nos. 2,222,264, 2,448,534 and 3,320,069) and thioether compounds (described, for example, in U.S. Pat. Nos. 3,271,157, 3,574,628 and 3,704,130).

The effect resulting from doping the hexacyano complex of the present invention may be particularly outstanding when a silver halide solvent is used. More specifically, by addition of a thioether compound, the shape of a high silver chloride (111) face type grain becomes easy to change, however, due to the effect of an iron cyano complex, change of the shape is prevented.

In order to accelerate the grain growth rate at the time of producing silver halide grains of the present invention, a method of increasing the addition rate, the addition amount and the addition concentration of a silver salt solution (e.g., $AgNO_3$ aqueous solution) and a halide solution (e.g., NaCl aqueous solution) as the addition proceeds is preferably used. This method is described, for example, in British Patent 1,335,925, U.S. Pat. Nos. 3,672,900, 3,650,757 and 4,242,445, JP-A-55-142329, JP-A-55-158124, JP-A-58-113927, JPA-58-113928, JP-A-58-111934 and JP-A-58-111936.

The water washing may be performed by a conventional flocculation method or ultrafiltration method. The flocculation method requires use of a flocculent and known flocculants include one having a sulfonic acid group and one having a carboxylic acid group. The pyridinium salt crystal habit modifier for use in the present invention intensely interacts with a sulfonic acid group and after desorption from a grain, it forms a salt with the flocculant and is difficultly removed in the water washing step. An example thereof is disclosed in Japanese Patent Application No. 7-230906. Accordingly, a flocculant having carboxylic acid group is preferably used. Examples of the flocculent having a carboxylic acid group are disclosed in British Patent 648,472.

The crystal habit modifier for use in the present invention is accelerated to desorb from the grain at a low pH. Accordingly, the pH at the water washing step is preferably low as long as the hexacyano complex does not decompose and the grains do not excessively aggregate. The pH is preferably from 3 to 4.5.

The silver halide grain of the present invention may be used as it is not subjected to chemical sensitization, however, if desired, the grain may be chemically sensitized. The example of the chemical sensitization includes gold sensitization using a so-called gold compound (described, for example, in U.S. Pat. Nos. 2,448,060 and 3,320,069), sensitization using a metal such as iridium, platinum, rhodium or palladium (described, for example, in U.S. Pat. Nos. 2,448,060, 2,566,245 and 2,566,263), sulfur sensitization using a sulfur-containing compound (described, for example, in U.S. Pat. No. 2,222,264), selenium sensitization using a selenium compound, reduction sensitization using a tin salt, thiourea dioxide or polyamine (described, for example, in U.S. Pat. Nos. 2,487,850, 2,518,698 and 2,521,925), and a combination of two or more thereof.

The silver halide grain of the present invention is particularly preferably subjected to gold sensitization, sulfur sensitization or a combination thereof.

The emulsion layer of the silver halide photographic light-sensitive material of the present invention may contain, in addition to silver halide grains of the present invention, commonly used silver halide grains.

In the photographic emulsion of the present invention containing high silver chloride grains for use in the present invention, the high silver chloride grains are preferably present at a proportion of 50% or more, more preferably 70% or more, most preferably 90% or more, of the projected area of all silver halide grains in the emulsion.

Also in the case where the photographic emulsion of the present invention and other photographic emulsion are used in combination, they are preferably mixed such that the high silver chloride grains for use in the present invention are present in the emulsion after mixing at a proportion of 50% or more.

Further, in the case where the photographic emulsion of the present invention and other photographic emulsion are used in combination, the emulsion used in combination is also preferably a high silver chloride emulsion having a silver chloride content of 50 mol % or more.

The emulsion of the present invention may be subjected to spectral sensitization with a methine dye or the like. Examples of the dye which can be used include a cyanine dye, a merocyanine dye, a complex cyanine dye, a complex merocyanine dye, a holopolar cyanine dye, a hemicyanine dye, a styryl dye and a hemioxonol dye. Among these, particularly useful dyes are those belonging to a cyanine dye, a merocyanine dye and a complex merocyanine dye. To these dyes, any nucleus commonly used in the cyanine dyes as a basic heterocyclic nucleus can be applied. More specifically, examples of the nucleus include a pyrroline nucleus, an oxazoline nucleus, a thiazoline nucleus, a pyrrole nucleus, an oxazole nucleus, a thiazole nucleus, a selenazole nucleus, an imidazole nucleus, a tetrazole nucleus, a pyridine nucleus, a nucleus resulting from fusion of an alicyclic hydrocarbon ring to these nuclei, and a nucleus resulting from fusion of an aromatic hydrocarbon ring to these nuclei, such as indolenine nucleus, benzindolenine nucleus, indole nucleus, benzoxazole nucleus, naphthoxazole nucleus, benzothiazole nucleus, naphthothiazole nucleus, benzoselenazole nucleus, benzimidazole nucleus and quinoline nucleus. These nuclei may have a substituent on the carbon atom.

To the merocyanine dye or the complex merocyanine dye, a 5- or 6-membered heterocyclic nucleus such as pyrazolin-5-one nucleus, thiohydantoin nucleus, 2-thiooxazolidine-2,4-dione nucleus, thiazolidine-2,4-dione nucleus, rhodanine nucleus, thiobarbituric acid nucleus, may be applied as a nucleus having a ketomethylene structure.

Examples thereof include compounds described in *Research Disclosure,* 17643, page 23, Item IV (December, 1978) and compounds described in references cited therein.

The time for adding a dye to an emulsion may be any stage known to be useful during the preparation of an emulsion, however, it is preferably added before water washing.

The addition amount of the dye may be from $4\times10^{-6}$ to $8\times10^{-3}$ per mol of silver halide, however, when the silver halide grain size is 0.2 to 3 $\mu$m as a more preferred embodiment, the addition amount is more effectively on the order of from $5\times10^{-5}$ to $2\times10^{-3}$ mol.

The silver halide emulsions prepared by the present invention can be used for both color photographic materials and black-and-white photographic materials. Examples of the color photographic materials include color paper, color photographing films and color reversal films, and examples of the black-and-white photographic materials include X-ray films, general photographing films and films for photographic materials for graphic arts printing. In particular, they can be preferably used for color paper and black-and-white photographic materials.

There in no particular limitation on other additives to the photographic materials to which the emulsions according to the present invention are applied, and reference can be made to the descriptions of, for example, *Research Disclosure,* Vol. 176, Item 17643 (RD17643) and *ibid.,* Vol. 187, Item 18716 (RD18716).

Portions of RD17643 and RD18716 in which various additives are described are listed below:

| | Type of Additives | RD17643 | RD18716 |
|---|---|---|---|
| 1. | Chemical Sensitizers | p.23 | p.648, right column |
| 2. | Sensitivity Increasing Agents | | p.648, right column |
| 3. | Spectral Sensitizers, Supersensitizers | pp.23–24 | p.648, right column to p.649, right column |
| 4. | Brightening Agents | p.24 | |
| 5. | Antifoggants, Stabilizers | pp.24–25 | p.649, right column |
| 6. | Light Absorbers, Filter dyes, UV Absorbers | pp.25–26 | p.649, right column to p.650, left column |
| 7. | Stain Inhibitors | p.25, right column | p.650, left to right columns |
| 8. | Dye Image Stabilizers | p.25 | |
| 9. | Hardeners | p.26 | p.651, left column |
| 10. | Binders | p.26 | p.651, left column |
| 11. | Plasticizers, Lubricants | p.27 | p.650, right column |
| 12. | Coating Aids, Surfactants | pp.26–27 | p.650, right column |
| 13. | Antistatic Agents | p.27 | p.650, right column |

Of the above-mentioned additives, examples of compounds which can be preferably used as antifoggants or stabilizers include azoles such as benzothiazolium salts, nitroimidazoles, nitrobenzimidazoles, chlorobenzimidazoles, bromobenzimidazoles, nitroindazoles, benzotriazoles and aminotriazoles; mercapto compounds such as mercaptothiazoles, mercaptobenzothiazoles, mercaptobenzimidazoles, mercaptothiadiazoles, mercaptotetrazoles (particularly, 1-phenyl-5-mercaptotetrazole), mercaptopyrimidines and mercaptotriazines; thioketo compounds such as oxazolinethione; azaindenes such as triazaindenes, tetraazaindenes (particularly, 4-hydroxy-substituted (1,3,3a,7)-tetraazaindenes) and pentaazaindenes; benzenethiosulfonic acid; benzenesulfinic acid; and benzenesulfonic acid amide.

As color couplers, non-diffusible couplers having hydrophobic groups called "ballast groups" in molecules or polymerized couplers are preferably used. The coupler may be either 4 equivalents or 2 equivalents based on silver ion. Colored couplers having the effect of color correction or couplers releasing development inhibitors with the progress of development (so-called DIR couplers) may be contained. Further, non-coloring DIR couplers providing colorless products by coupling reactions and releasing development inhibitors may be contained.

Examples of magenta couplers include 5-pyrazolone couplers, pyrazolobenzimidazole couplers, pyrazolotriazole couplers, pyrazolotetrazole couplers, cyanoacetylcoumarone couplers and open-chain acylacetonitrile couplers. Examples of yellow couplers include acylacetamide couplers (for example, benzoylacetanilides and pivaloylacetanilides). Examples of cyan couplers include naphthol couplers and phenol couplers. As the cyan couplers, a phenol coupler having an ethyl group at the meta-position of a phenol nucleus, a 2,5-diacylamino-substituted phenol coupler, a phenol coupler having a phenylureido group at the 2-position and an acylamino group at the 5-position and a coupler substituted by a sulfonamido group or an amido group at the 5-position of a naphthol nucleus, which are described in U.S. Pat. Nos. 3,772,002, 2,772,162, 3,758,308, 4,126,396, 4,334,011, 4,327,173, 3,446,622, 4,333,999, 4,451,559 and 4,427,767, are preferably used because of their excellent image fastness.

In order to satisfy the characteristics required for the photographic materials, two or more of the above-mentioned couplers can be used in combination in the same layer, or the same compound may be of course added to two or more different layers.

Typical examples of antifading agents include hydroquinones, 6-hydroxychromans, 5-hydroxycoumarans, spirochromans, p-alkoxyphenols, hindered phenols such as bisphenols, gallic acid derivatives, methylenedioxybenzenes, aminophenols, hindered amines and ether or ester derivatives obtained by silylating or alkylating phenolic hydroxyl groups of these compounds. Further, metal complexes represented by (bissalicylaldoximato)nickel complexes and (bis-N,N-dialkyldithiocarbamato)nickel complexes can also be used.

For photographic processing of the photographic materials produced by the present invention, any of the well-known methods can be used, and well-known processing solutions can be used. The processing temperature is usually selected between 18° C. and 50° C., but it may be lower than 18° C., or higher than 50° C. Both development processing for forming silver images (black-and-white photographic processing) and color photographic processing comprising development processing for forming dye images are applicable according to their purpose.

In black-and-white developing solutions, well-known developing agents such as dihydroxybenzenes (for example, hydroquinone), 3-pyrazolidones (for example, 1-phenyl-3-pyrazolidone) and aminophenols (for example, N-methyl-paminophenol) can be used alone or in combination.

Color developing solutions are generally aqueous alkaline solution containing color developing agents. As the color developing agents, there can be used known aromatic primary amine developing agents such as phenylenediamines (for example, 4-amino-N,N-diethylaniline, 3-methyl-4-amino-N,N-diethylaniline, 4-amino-N-ethyl-N-β-hydroxyethylaniline, 3-methyl-4-amino-N-ethyl-N-β-hydroxyethylaniline, 3-methyl-4-amino-N-ethyl-N-β-methanesulfoamidoethylaniline and 4-amino-3-methyl-N-ethyl-N-β-methoxyethylaniline).

Besides these, additives described in L. F. A. Maison, *Photographic Processing Chemistry,* Focal Press, pp. 226–229 (1966), U.S. Pat. Nos. 2,193,015 and 2,592,364, JP-A-48-64933, etc. may also be used.

In addition, the color developing solutions can contain pH buffers such as sulfites, carbonates, borates and phosphates, of alkali metals; and developing inhibitors or antifoggants such as bromides, iodides and organic antifoggants. Further, the color developing solutions may contain hard-water softeners, preservatives such as hydroxylamine, organic solvents such as benzyl alcohol and diethylene glycol, development accelerators such as polyethylene glycol, quaternary ammonium salts and amines, dye forming couplers, competitive couplers, fogging agents such as sodium boron hydride, auxiliary developing agents such as 1-phenyl-3-pyrazolidone, tackifiers, polycarboxylic acid chelating agents described in U.S. Pat. No. 4,083,723 and antioxidants described in German Patent Application (OLS) No. 2,622,950, as required.

In the case of the color photographic processing, the photographic materials are generally subjected to bleach-processing after color development. Bleach-processing may be carried out simultaneously with fix-processing or separately. As bleaching agents, for example, compounds of polyvalent metals such as iron (III), cobalt (III), chromium (IV) and copper (II), peracids, quinones and nitroso compounds are used. Typical examples of the bleaching agents include ferricyanides; bichromates; organic complex salts of iron (III) or cobalt (III), for example, complex salts of aminopolyqarboxylic acids such as ethylenediaminetetraacetic acid, nitrilotriacetic acid and 1,3-diamino-2-propanoltetraacetic acid, or complex salts of organic acids such as citric acid, tartaric acid and maleic acid; persulfates; permanganates; and nitrosophenol. Of these, potassium ferricyanide, sodium ethylenediaminetetraacetato iron (III) and ammonium ethylenediaminetetraacetato iron (III) are particularly useful. The complex salts of ethylenediaminetetraacetato iron (III) are also useful for both independent bleaching solutions and one bath-bleach-fixing solution.

The bleaching or bleach-fixing solutions may also contain various additives, in addition to bleaching accelerator described in U.S. Pat. Nos. 3,042,520 and 3,241,966, JP-B-45-8506 (the term "JP-B" as used herein means an "examined Japanese patent publication"), JP-B-45-8836, etc. and thiol compounds described in JP-A-53-65732. After bleaching or bleach-fixing, the photographic materials may be subjected to washing, or may only be subjected to stabilizing processing.

The present invention will be described in greater detail below with reference to examples, however, the present invention should not be construed as being limited thereto.

EXAMPLE 1

Preparation of Pure Silver Chloride Regular Crystal Grains

Into 1 l of water, 4.8 g of sodium chloride and 30 g of inert gelatin were added, and to the vessel kept at 60° C., 600 ml of an aqueous silver nitrate solution (silver nitrate: 21.3 g) and 600 ml of an aqueous sodium chloride solution (sodium chloride: 7.74 g) were added while stirring by a double jet process over 20 minutes. Five minutes after completion of the addition, $2.0\times10^{-3}$ mol of Crystal Habit Modifier 1 was added. Then, starting from 5 minutes after the addition of the crystal habit modifier, 300 ml of an aqueous silver nitrate solution (silver nitrate: 112.5 g) and 300 ml of an aqueous sodium chloride solution (sodium chloride; 40.14 g) were added over 60 minutes.

At the same time with the addition of silver nitrate, an aqueous solution of $K_4[Fe(CN)_6].3H_2O$ was added. The layer where $K_4[Fe(CN)_6]\cdot3H_2O$ was added was the outside of a grain and constituted the shell part. The addition amount (molar ratio to silver nitrate) and the ratio of the shell part to the total grain volume are shown in Table 1.

After completion of the addition, the temperature was lowered to 40° C., an aqueous solution containing a copolymer of isobutene with monosodium maleate was added to make the total amount of 3 l, and then the pH was reduced using a sulfuric acid until silver halide precipitated. A supernatant corresponding to 85% of the total volume was removed (first water washing). Then, distilled water in an amount equal to the amount of the supernatant removed was added and thereto a sulfuric acid was added until silver halide precipitated. A supernatant corresponding to 85% of the total volume was again removed (second water washing). The same operation as the second water washing was performed once more (third water washing) and the desilvering step was completed.

Thereafter, 80 g of gelatin, 85 ml of phenol (5%) and 242 ml of distilled water were added. The pH and the pAg were adjusted to 6.2 and 7.5, respectively, using sodium hydroxide and silver nitrate solution. Thus, pure silver chloride grains having an average sphere-corresponding diameter of 0.55 μm were obtained.

TABLE 1

| Grain | Concentration of Hexacyano Complex in Doped Layer (mol/mol-Ag) | Ratio of Doped Layer (%) | Shape of Grain Immediately after Formation | Shape of Grain after Ripening | |
|---|---|---|---|---|---|
| 1 | — | — | octahedral | sphere, deformed | Comparison |
| 2 | $7.0\times10^{-5}$ | 30 | octahedral | edge was dissolved | Comparison |
| 3 | $2.5\times10^{-4}$ | 30 | octahedral | octahedral | Invention |
| 4 | $1.0\times10^{-3}$ | 12 | octahedral | octahedral | Invention |
| 5 | $1.0\times10^{-3}$ | 3 | octahedral | octahedral | Invention |
| 6 | — | — | tabular | amorphous | Comparison |
| 7 | $7.0\times10^{-5}$ | 30 | tabular | edge was dissolved | Comparison |
| 8 | $2.5\times10^{-4}$ | 30 | tabular | tabular | Invention |
| 9 | $1.0\times10^{-3}$ | 12 | tabular | tabular | Invention |
| 10 | $1.0\times10^{-3}$ | 3 | tabular | tabular | Invention |

EXAMPLE 2

Preparation of Pure Silver Chloride Tabular Grains

Into 1.68 l of water, 3.8 g of sodium chloride, 2.4 mmol of Crystal Habit Modifier 1 and 10 g of inert gelatin was added, and to the vessel kept at 30° C., 28.8 ml of an aqueous silver nitrate solution (silver nitrate: 7.34 g) and 28.8 ml of an aqueous sodium chloride solution (sodium chloride: 2.71 g) were added while stirring by a double jet process over 1 minute. Two minutes after completion of the addition, 188 g of a 10% aqueous inert gelatin solution was added. Within subsequent 15 minutes, the temperature of the reaction vessel was increased to 75° C. After ripening the mixture at 75° C. for 12 minutes, 480 ml of an aqueous silver nitrate solution (silver nitrate: 122.7 g) and an aqueous sodium chloride solution were added over 39 minutes at an accelerated flow rate. During this process, the electric potential was kept at +100 mV to the saturated calomel electrode.

At the same time with the addition of silver nitrate, an aqueous solution of $K_4[Ru(CN)_6]$ was added. The layer where $K_4[Ru(CN)_6]$ was added was the outside of a grain and constituted the shell part. The addition amount (molar ratio to silver nitrate) and the ratio of the shell part to the total grain volume are shown in Table 1.

After completion of the addition, the temperature was lowered to 40° C., an aqueous solution containing a copolymer of isobutene with monosodium maleate was added to make the total amount of 3 l, and then the pH was reduced using a sulfuric acid until silver halide precipitated. A supernatant corresponding to 85% of the total volume was removed (first water washing). Then, distilled water in an amount equal to the amount of the supernatant removed was added and thereto a sulfuric acid was added until silver halide precipitated. A supernatant corresponding to 85% of the total volume was again removed (second water washing). The same operation as the second water washing was performed once more (third water washing) and the desilvering step was completed.

Thereafter, 80 g of gelatin, 85 ml of phenol (5%) and 242 ml of distilled water were added. The pH and the pAg were adjusted to 6.2 and 7.5, respectively, using sodium hydroxide and silver nitrate solution. Thus, pure silver chloride tabular grains having an average sphere-corresponding diameter of 0.85 $\mu$m and an average thickness of 0.12 $\mu$m were obtained.

EXAMPLE 3

Test of Shape Stability of Silver Chloride Grains of The Present Invention

Silver chloride grains produced in Examples 1 and 2 each was stirred at 60° C. for 60 minutes and ripened. The shapes of grains immediately after grain formation (before water washing) and after ripening are shown in Table 1 and FIGS. 1 to 3. From these, it is verified that change in the shape of grains was extremely reduced by adding a hexacyano complex.

EXAMPLE 4

An emulsion comprising Grain 8 obtained in Example 1 was used in the fifth layer of a light-sensitive material as Sample 6 (Test No. 101) in Example 3 of JP-A-6-258788 and the light-sensitive material was processed in the same manner as in Example 3 of JP-A-6-258788. Then, good performance was obtained.

EXAMPLE 5

An emulsion comprising Grain 8 obtained in Example 2 was used as an emulsion of Light-Sensitive Material X in Example 1 of JP-A-6-273866 and Light-Sensitive Material X was combined with Screen B and processed in the same manner as in Example 1 of JP-A-6-273866. Then, good performance was obtained.

While the invention has been described in detail and with reference to specific embodiments thereof, it will be apparent to one skilled in the art that various changes and modifications can be made therein without departing from the spirit and scope thereof.

What is claimed is:

1. A silver halide photographic material comprising a support having thereon at least one silver halide emulsion layer, wherein the silver halide grains contained in said silver halide emulsion layer have a silver chloride content of 50 mol % or more, 30% or more of the surface area of the grains comprise a (111) face, and the silver halide grains are formed in the presence of at least one compound represented by formula (I) and contain a hexacyano complex represented by formula (II) such that the outermost layer of the grains has a hexacyano complex concentration of at least $1\times10^{-4}$ mol/mol-Ag:

(I)

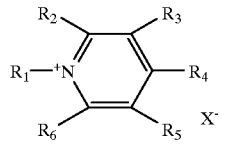

(II)

$[M(CN)_6]^{n-}$ wherein in formula (I), $R_1$ represents an alkyl group, an alkenyl group or an aralkyl group, $R_2$, $R_3$, $R_4$, $R_5$ and $R_6$ each represents a hydrogen atom or a group capable of substitution, $R_2$ and $R_3$, $R_3$ and $R_4$, $R_4$ and $R_5$ or $R_5$ and $R_6$ may be condensed to form a ring, provided that at least one of $R_2$, $R_3$, $R_4$, $R_4$, $R_5$ and $R_6$ is an aryl group and $R_1$, $R_2$, $R_3$, $R_4$, $R_5$ and $R_6$ each include no pyridinium group, and $X^-$ represents a counter anion; and in formula (II), M is selected from the group consisting of transition metals belonging to Group V-A, Group VI-A, Group VII-A and Group VIII of Periods 4, 5 and 6 in the Periodic Table, and n represents 3 or 4;

wherein said outermost layer of the grains is defined by a ratio of shell part to total grain volume, wherein said ratio varies from 3 to 30%.

2. The silver halide photographic emulsion as claimed in claim 1, wherein the outermost layer containing the hexacyano complex accounts for 50% by volume or less of all grains.

3. The silver halide photographic emulsion as claimed in claim 1, wherein the metal contained in the hexacyano complex is selected from the metals belonging to Group VIII.

4. The silver halide photographgic emulsion as claimed in claim 1, wherein the compound represented by formula (I) is used in an amount of $6\times10^{-5}$ mol or more per mol of silver halide.

* * * * *